US008308517B1

(12) United States Patent
Shivers, III et al.

(10) Patent No.: US 8,308,517 B1
(45) **Date of Patent: *Nov. 13, 2012**

(54) METHOD FOR OFFSHORE NATURAL GAS PROCESSING USING A FLOATING STATION, A SOFT YOKE, AND A TRANSPORT SHIP

(75) Inventors: Robert Magee Shivers, III, Houston, TX (US); William T. Bennett, Jr., Houston, TX (US); David Trent, Houston, TX (US)

(73) Assignee: ATP Oil & Gas Corporation, Houston, TX (US)

( * ) Notice: Subject to any disclaimer, the term of this patent is extended or adjusted under 35 U.S.C. 154(b) by 55 days.

This patent is subject to a terminal disclaimer.

(21) Appl. No.: 13/025,524

(22) Filed: Feb. 11, 2011

(51) Int. Cl.

| | |
|---|---|
| ***B63B 21/50*** | (2006.01) |
| ***B63B 22/02*** | (2006.01) |
| ***B63B 22/26*** | (2006.01) |
| ***B63B 35/44*** | (2006.01) |
| ***F17C 7/02*** | (2006.01) |
| ***F17C 9/00*** | (2006.01) |
| ***F25J 1/00*** | (2006.01) |

(52) U.S. Cl. ..... 441/4; 114/230.14; 114/230.15; 114/230.17; 141/387; 137/615; 62/50.1; 62/53.2; 62/611

(58) Field of Classification Search ..... 114/230.1, 114/230.13–230.18; 441/3–5; 62/50.1–50.7, 62/53.2, 611–614; 141/279, 387, 388; 137/615
See application file for complete search history.

(56) References Cited

U.S. PATENT DOCUMENTS

| | | | | |
|---|---|---|---|---|
| 4,041,721 | A * | 8/1977 | Kniel | 62/53.2 |
| 4,315,533 | A * | 2/1982 | Eagles | 141/387 |
| 4,494,475 | A * | 1/1985 | Eriksen | 114/230.14 |
| 4,735,167 | A * | 4/1988 | White et al. | 114/230.14 |
| 5,025,860 | A * | 6/1991 | Mandrin | 166/267 |
| 6,250,244 | B1 * | 6/2001 | Dubar et al. | 114/264 |
| 6,889,522 | B2 * | 5/2005 | Prible et al. | 62/611 |
| 8,100,076 | B1 * | 1/2012 | Shivers et al. | 114/230.14 |
| 8,104,416 | B1 * | 1/2012 | Shivers et al. | 114/230.14 |
| 8,104,417 | B1 * | 1/2012 | Shivers et al. | 114/230.14 |
| 8,186,170 | B2 * | 5/2012 | Boatman et al. | 62/50.2 |

* cited by examiner

*Primary Examiner* — Ajay Vasudeva
(74) *Attorney, Agent, or Firm* — Buskop Law Group, PC; Wendy Buskop

(57) ABSTRACT

A method for receiving dry gas and forming liquefied natural gas on a floating vessel, and offloading the liquefied natural gas using telescoping mooring arms to a floating transport vessel is disclosed herein. The method can include mooring the floating vessel to a seabed with a mooring spread, using a soft yoke to moor the transport vessel to the floating vessel, receiving a dry gas, cooling the dry gas forming a liquefied nature gas, transferring the liquefied natural gas to the transport vessel, transferring personnel and equipment over a gangway, returning hydrocarbon vapor to the floating vessel, cooling the hydrocarbon vapor, and using the hydrocarbon vapor as a fuel for the floating vessel.

10 Claims, 14 Drawing Sheets

METHOD FOR OFFSHORE NATURAL GAS PROCESSING USING A FLOATING STATION, A SOFT YOKE, AND A TRANSPORT SHIP

FIELD

The present embodiments generally relate to a method for offshore liquefied natural gas processing using a floating natural gas processing station, a soft yoke and a transport vessel.

BACKGROUND

A need exists for a method for processing natural gas while offshore on a floating moveable, relocatable vessel.

A need exists for a natural gas processing method provides safe tendering, safe offloading of cargo and personnel, and safe transfer of personnel and safe return of hydrocarbon vapor from transport vessels to the floating natural gas processing station.

A need exists for a method that is moveable and relocatable and usable at different well sites from one area of the Gulf of Mexico to another area of the Gulf of Mexico. A need exists for a method that can process natural gas while dynamically reacting to environmental conditions, such as wind and waves. A need has exists for a method that operates a device that can extend and retract a jib nested within a boom to maintain a floating vessel a nominal distance from a floating natural gas processing station while allowing the transfer of people, loads of materials in a gangway simultaneously with allowing transfer of processed liquefied natural gas and return of hydrocarbon vapor for additional processing or for fueling equipment running onboard a floating processing station.

A further need exists for a method for processing natural gas at sea that has quick connect and quick release steps to quickly connect transport ships to the station and to provide emergency release of the ships from station.

A need exists for a method for processing natural gas that can adjust distances between the processing station and a transport vessel depending on seas, weather conditions and size of the transport vessel, and then cease flowing of fluid and quickly releasing the transport ship in anticipation of a major storm, such as a hurricane or another 100 year storm.

The present embodiments meet these needs.

BRIEF DESCRIPTION OF THE DRAWINGS

The detailed description will be better understood in conjunction with the accompanying drawings as follows.

Figure 1A:
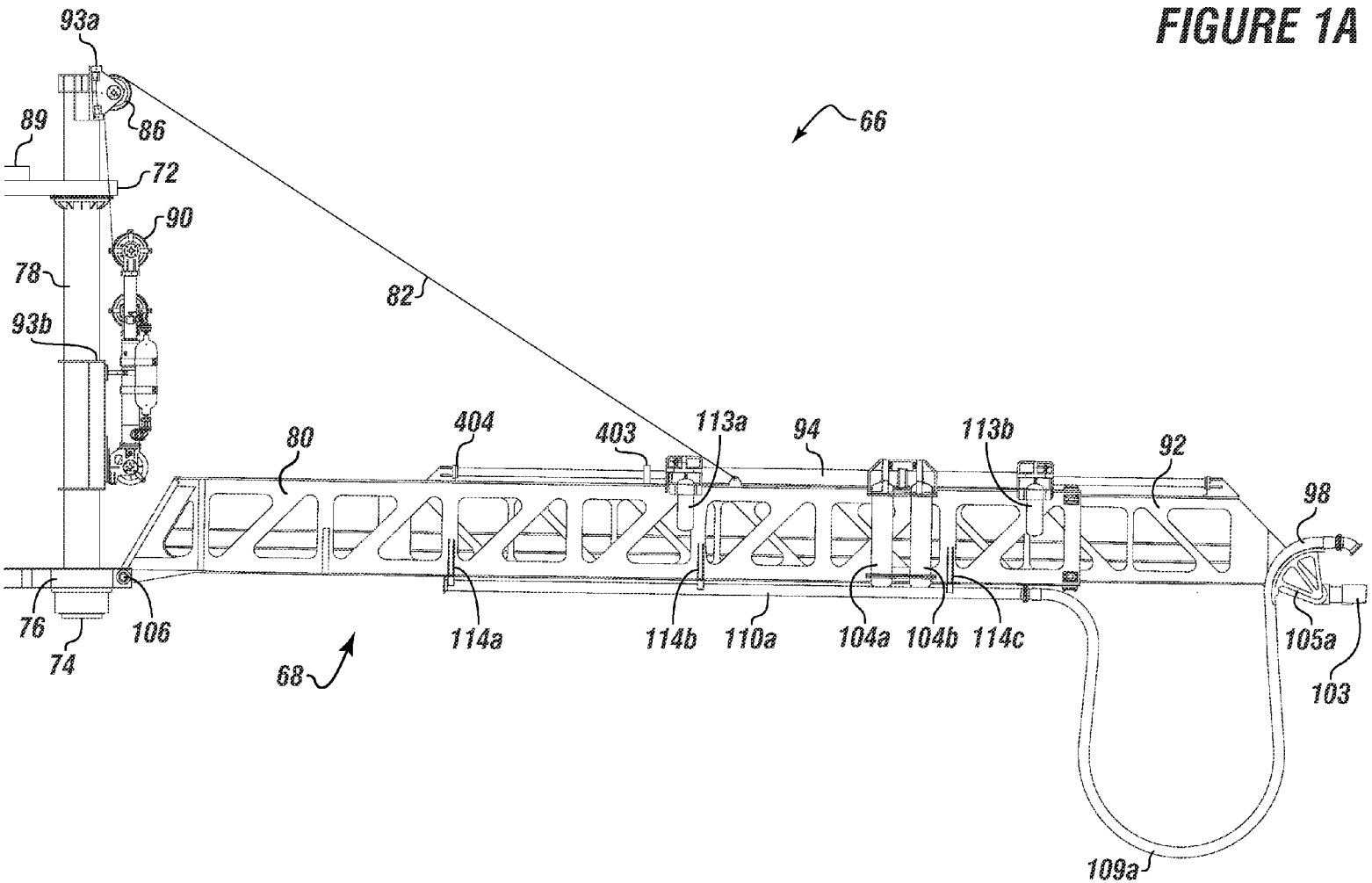
FIG. 1A depicts a first side view of a soft yoke with a boom in a second position for use on a natural gas processing station to maintain a transport vessel apart from the station.

The present embodiments are detailed below with reference to the listed Figures.

DETAILED DESCRIPTION OF THE EMBODIMENTS

Before explaining the present method in detail, it is to be understood that the method is not limited to the particular embodiments and that it can be practiced or carried out in various ways.

The present embodiments generally relate to a floating relocatable method for processing natural gas at sea using a cryogenic heat exchanger and a natural gas liquefaction train and offloading conduits that are flexible and adjustable allowing cargo to be moved while a vessel is experiencing the 6 degrees of movement that a floating vessel can experience not limited to pitch, heave, yaw, and roll.

The method has as a first step, receiving dry gas, processing dry gas into liquefied natural gas, and offloading the processed liquefied natural gas with continuous and detailed monitoring and control of the offloading process preventing excursions into the sea or BP like accidents which occurred in the Gulf of Mexico in 2010.

The method can include processing natural gas on a floating vessel with a hull, and various inlet conduits offload conduits, vapor return conducts, a heat exchanger and a liquefaction train while using two telescoping mooring arms for assistance in the offloading process between the floating station and a transport vessel.

The method can include using a station controller, such as a computer system connected to various transducers, or sensors for monitoring the receipt, storage, and offloading of the processed liquefied natural gas.

For example, the method involves the steps of monitoring loading rate, processing station draft, temperature in conduits, processed tonnage, station trim and motion, and compare real time data to stored data indicating preset parameters, wherein the preset data can be in a data storage associated with a processor to either send off alarms if the loading rates, pressures or temperatures exceed are outside predefined limits for a certain weather condition.

The method should provide alarms when excessive pitch, yaw, roll, surge, sway, and heave occur, such as during a 20 knot storm.

In an embodiment, the method can include using dynamic positioning to keep the offshore processing in a designated location. Using onboard removable thrusters connected to a station keeping device, the method provides dynamic positioning of the station using either GPS coordinates or use preset distances from specific transport ships that arrive to offload the liquefied natural gas.

The method maintains each transport ship a safe but workable distance from the processing equipment to permit safe offloading of personnel, gear, and liquefied natural gas and the return of the vapor formed during offloading to either run the processing equipment or to be re-cooled using an onboard heat exchanger, such as a cold box and then processing the hydrocarbon vapor through an onboard liquefaction train.

The method can include that the hydrocarbon vapor formed during loading of the liquefied natural gas can power generators that power the liquefaction train and other equipment on the natural gas processing station.

The method can include using a processing source that connects to a pretreatment source that can be on another vessel.

The method can include using a dehydrator on the pretreatment source for removing water from the natural gas.

The pretreatment source can contain an optional heat exchanger that cryogenically cools the dehydrated gas also referred to as "dry gas" herein, to a first cool temperature before transferring the dry gas to the floating, moveable natural gas processing station.

The method can include that one or two liquefaction trains and a heat exchanger can be positioned on a floating station hull with a station variable draft, such as a semi-submersible hull. Other hull types can be used as well such as a connected multi-column hull.

The method can include having the floating hull spread moored using between 8 mooring lines and 12 mooring lines.

The method can include using a spread of mooring lines, such that if 2 of the mooring lines break such as during a hurricane, the remaining mooring lines will hold the floating vessel. The mooring lines can be wire rope or chain and wire rope or similar material used for mooring to anchors in the sea bed, such as suction pile anchors.

In another embodiment of the method, the method for processing natural gas can use a spread moored turret connected to the station hull.

An inlet conduit can be used to flow the dry gas from the pretreatment source to the station through the center of the spread moored turret. This orientation allows the floating natural gas station to weather vane and swivel into the wind, reducing possibility of damage and reducing possibility of loss of equipment during high winds or gales of more than 20 knots.

The method can include receiving dry gas through the aforementioned inlet conduit. The dry gas can be primarily methane with small amounts of ethane, propane and butane and less than 10 percent heavier components, with at least 65 percent of acid gas and water vapor removed.

In an embodiment, the dry gas can be pre-cooled in the pretreatment source prior to transferring the dry gas to the liquefaction train. The pre-cooling reduces the temperature of the dry gas by at least 300 percent The method can cool the dry gas in one step, or in multiple steps using multiple heat exchangers.

The method has as the next step processing the cooled dry gas in one or more on-board natural gas liquefaction trains.

The natural gas liquefaction train can be of several types to be useful in this method, such as a dual expansion nitrogen cycle assembly or another natural gas liquefaction train, such as a single mixed refrigerant assembly, a dual mixed refrigerant assembly, or a cascade refrigerant assembly.

The method flows the cryogenic liquefied natural gas to a soft yoke and ultimate a transport vessel using station flexible conduits that are flexible and can lengthen or shorten depending on weather conditions and spacing needed between a transport ship and the floating station.

The floating station can be ballasted for use in water of about 200 feet deep or deeper.

The method can use monitoring devices for inlet conduit monitoring, liquefaction process monitoring, offload monitoring and vapor return conduit monitoring.

In an embodiment the method can use sensors connected to a station controller to monitor temperature, pressure and flow rates of the fluid flow and compare the monitored values to preset limits in data storage associated with the processor of the station controller.

For example, the method can include using the station controller to control the flow rates through the inlet conduit.

In another example, the station controller can monitor the heat exchanger temperatures and the outlet conduit flow rates.

The station controller can also be used to monitor details from the inlet conduit such as by monitoring dry gas flow rates, dry gas temperatures, and dry gas pressures, and then comparing the monitored rates to preset limits in data storage of the station controller. The method can use a processor to assist in this monitoring step.

The station controller can control the inlet conduit by being connected to one or more emergency shut off devices.

The station controller can monitor the station heat exchanger by monitoring rates of temperature and flow rates of pre-cooled gas and by monitoring temperatures and flow rates of refrigerant used in the heat exchanger.

The station controller can monitor the outlet conduits by monitoring the vapor return rates, temperatures of the vapor and pressures of the returning vapor.

The method can include using a primary quick connect/disconnect connector, a secondary emergency disconnect connector and a tertiary emergency disconnect connector to hold the floating vessel with liquefaction train to a transport vessel using soft yoke mooring arms.

The method can include using a soft yoke with two telescoping mooring arms for connecting any one of a variety of shapes and sizes of transport ships to the floating liquefied natural gas processing station.

The method uses a soft yoke that provides telescoping mooring arms that each pivot in two positions, in a first position around a king post at an 90 degree angle or a slightly greater angle, such as 120 degrees, and in a second position from a substantially horizontal position to a vertical position relative to the surface of the vessel deck or surface of the sea.

The method can use the two telescoping mooring arms to perform four tasks simultaneously, (1) hold the transport ship apart from the floating station, to transfer people between the floating station and a transport ship, (2) transfer LNG from the floating station to the transport vessel, and (3) transfer hydrocarbon vapor from the transport vessel to the floating station, and (4) provide quick connect/disconnects between the station and the floating vessel in the event of a disaster.

In one or more embodiments, a stiffness of the telescoping mooring arms can operate within a range from about 2.5 tons per foot to about 10 tons per foot.

The soft yoke and the two telescoping mooring arms can be made of steel, aluminum, a composite, or another structural material.

The soft yoke telescoping mooring arms each can have a length from about 50 feet to about 150 feet, and a width from about 7 feet to about 14 feet. However, the size of the soft yoke can be different depending upon the particular application.

The telescoping mooring arms can be perforated, allowing wind to flow through the soft yoke mooring arms so excessive pressure does not build on the arms by high winds. The telescoping mooring arms can be formed from tubular steel connected together, such as by welding forming a lattice type construction.

Each telescoping mooring arm usable in the method can have an upper connecting mount for engaging the floating natural gas processing station. The upper connecting mount can be a rotational mount and can include a gear for rotating the soft yoke relative to the floating natural gas processing station.

Each soft yoke telescoping mooring arm usable in the method can have a lower connecting mount for engaging the floating natural gas processing station. The lower connecting mount can be a rotational mount and can include a gear for rotating the soft yoke relative to the floating natural gas processing station.

Each soft yoke telescoping mooring arm usable in the method can have a turn table connected to the lower connecting mount, which can provide a walking surface and a pivoting structural anchoring point for a boom.

Each soft yoke telescoping mooring arm can have a king post engaged with the turn table and the upper connecting mount. The turn table can be configured to rotate with the king post.

Each soft yoke mooring arm can have a boom pivotably connected to the turn table and to at least one wire, which can also be termed herein "a luffing wire".

The luffing wires can be made of composite fiber or steel. Each luffing wire can be engaged with a turn down sheave, which can be mounted to the king post.

Each luffing wire can also be engaged with a tensioner. The tensioner can be a hydraulic cylinder accumulator assembly, which can function as a pneumatic tensioning device for the luffing wire. The tensioner can be configured to apply tension to and release tension from the luffing wires, which can connect to a jib. Slack can be provided to luffing wires that engage between the jib and tensioners.

Each soft yoke mooring arm can have a jib, which can be telescopically disposed within the boom.

The dimensions of the jib can include a length from about 50 feet to about 100 feet, and a width from about 7 feet to about 14 feet.

The jib can be connected to at least one centralizing cylinder, which can be a hydraulic cylinder accumulator assembly.

The centralizing cylinders can operate to control a position of the jib within the boom. For example, the centralizing cylinders can be configured to extend and retract the jib relative to the boom. The centralizing cylinder can have a capacity ranging from about 200 psi to about 2000 psi, or any psi depending upon the application.

The jib can extend out of an end of the boom, and can retract into the boom. The jib can also slide into the boom. The boom and jib can further form a gangway.

The extension and retraction of the jib can be adjusted to account for wave motion, current motion, wind motion, transport ship dynamics, floating natural gas processing station dynamics, changes in draft, and other such variables. As such, the jib can be operated to maintain a nominal standoff position within preset limits for holding a transport ship within predefined distances from the floating natural gas processing station.

Each soft yoke mooring arm can have one or more conduits, including a first conduit for communicating fluid from the floating natural gas processing station to a transport ship for loading the liquefied natural gas.

The yoke offload conduit can be in fluid communication with one or more storage tanks on a transport ship, and fluid can be pumped, or can otherwise flow, from the floating natural gas processing station to the ship.

Each soft yoke mooring arm can have a second conduit termed a "vapor return flexible conduit" for communicating vapor formed during offloading of the fluid back to the floating station for use in running the liquefaction train or other station power plants.

The soft yoke offload conduit can connect to the station offload conduit, and the soft yoke vapor return conduit can connect to the station vapor return conduit.

During the flowing of the fluid to the transport vessel, certain hydrocarbon based fluids, such as liquefied natural gas, can form a vapor. The second conduit can receive the formed vapor and flowing the formed vapor from the transport ship to the floating natural gas processing station for reprocessing the vapor or use as a fuel. The formed vapor can be cooled such as with the station heat exchanger.

Each soft yoke mooring arm forms an enclosed gangway with openings when the jib of the soft yoke mooring arm can be nested in the boom of the soft yoke mooring arm. The enclosed gangway can support movement of personnel and equipment up to 800 pounds at least, between the transport ship and the floating natural gas processing station.

The method considers using the soft yoke to extend the mooring arms up to any length required to maintain a predefined distance between a transport ship and the floating natural gas processing station, for example from +/−5 feet to +/−30 feet.

Figure 1B:
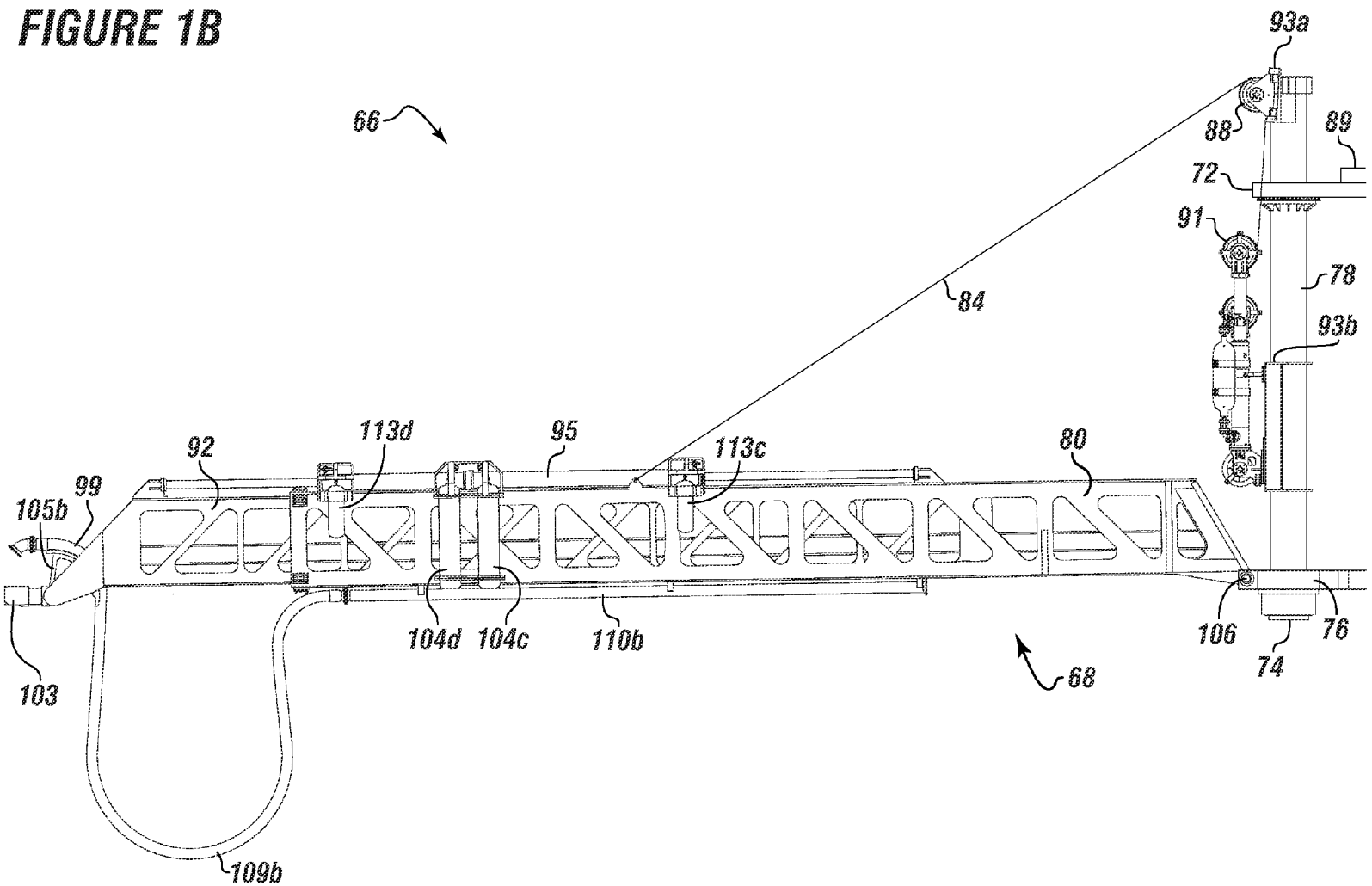
FIG. 1B shows a second side view of the soft yoke with the boom in the second position.

FIG. 1A depicts a side view of a soft yoke 66 with a first telescoping soft yoke mooring arm 68. FIG. 1B shows the opposite side of the soft yoke 66 shown in FIG. 1A.

Referring now to both FIGS. 1A and 1B, the first telescoping soft yoke mooring arm 68 can include an upper connecting mount 72 for engaging a floating natural gas processing station, a fixed or floating vessel, a floating structure, or the like.

The first telescoping soft yoke mooring arm 68 can include a lower connecting mount 74 for engaging the floating natural gas processing station, fixed or floating vessel, floating structure, or the like.

The upper connecting mount 72 and the lower connecting mount 74 can have a diameter from about 48 inches to about 84 inches, and can be made of powder coated steel.

The first telescoping soft yoke mooring arm 68 can be actuated by a soft yoke controller 89, which can be in communication with a station controller (shown in FIG. 3A), or the first telescoping soft yoke mooring arm 68 can be actuated by the station controller.

The soft yoke 66 can include a turn table 76 connected to the lower connecting mount 74. The dimensions of the turn table 76 can be from about 9 feet to about 12 feet in diameter. The turn table 76 can have a thickness from about 12 inches to about 24 inches, and can be made of steel with an internal bearing of bronze or another frictionless material.

The soft yoke 66 can include a king post 78 that engages with the turn table 76, the upper connecting mount 72, and the lower connecting mount 74. The turn table 76 can be configured to rotate with the king post 78. The king post 78 can be connected to a first tensioner 90 and a second tensioner 91 by a tensioner mount 93*b*.

The king post 78 can be made of steel, and can have a length of from about 12 feet to about 50 feet and a diameter from about 3 feet to about 6 feet. The king post 78 can be a rolled tube with a hollow portion.

The soft yoke 66 can have a boom 80 connected to the turn table 76. The boom 80 can have a length from about 40 feet to about 140 feet, a height from about 8 feet to about 14 feet, and a width from about 8 feet to about 16 feet.

In embodiments, the boom 80 can be a tubular. The boom 80 can have a diameter from about 14 feet to about 16 feet. The boom 80 can include hollow tubulars welded together to reduce cost in shipping. The boom 80 can be configured to not fail upon impacts and slams, which can occur to the floating natural gas processing station to which the boom 80 is attached. For example, the boom 80 can be configured to not fail upon impacts and slams during a 20 year storm, according the US Coast Guard classification of a 20 year storm with wave sizes of up to 12 feet and a frequency of from about 2 feet to about 3 feet.

A heel pin 106 can connect the boom 80 to the turn table 76, allowing the boom 80 to rotate relative to the turn table 76. A typical heel pin can be machined from cold drawn high strength steel shafting, and can have a length from about 6 inches to about 18 inches and a diameter from about 6 inches to about 12 inches. The boom 80 can be locked into the turn table 76 using a collet and locking pin.

Figure 1C:
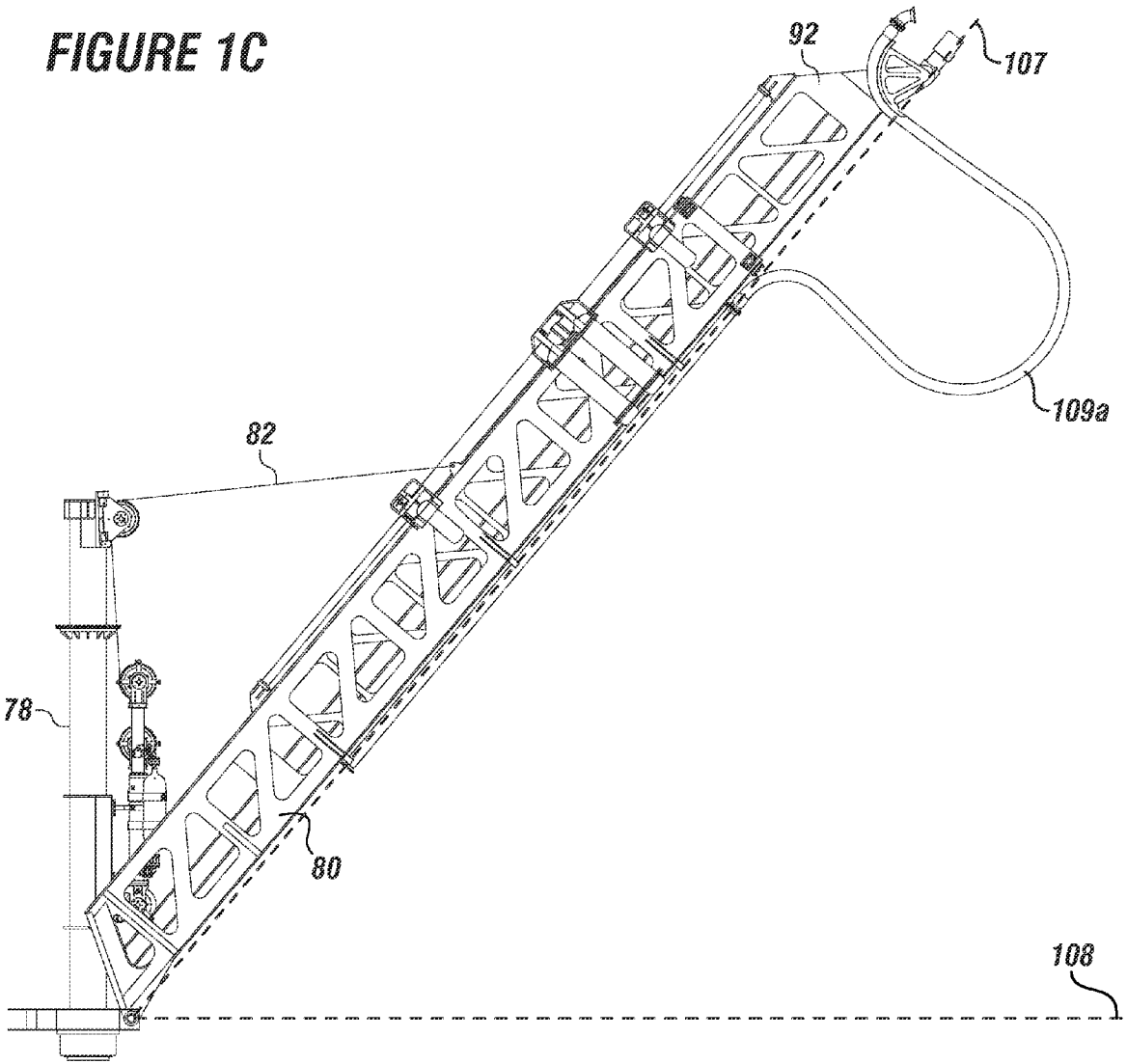
FIG. 1C shows the first side view of the soft yoke in a first refracted position.

As such, the boom 80 can pivot from a first position, such as with the boom 80 extending to a substantially parallel position with the king post 78 (which is shown in FIG. 1C), to a second position, such as with the boom 80 extending substantially perpendicular to the king post 78. The boom 80 can pivot to any position between the first position and the second position, such as by using a first luffing wire 82 and a second luffing wire 84. The boom 80 is depicted in the second position in FIGS. 1A-1B.

The first luffing wire 82 and the second luffing wire 84 can each connect to the boom 80 at one end and to the king post 78 at the opposite end. The first luffing wire 82 can engage a first turn down sheave 86 mounted to the king post 78. The second luffing wire 84 can engage a second turn down sheave 88 mounted to the king post 78. The first and second turn down sheaves 86 and 88 can be mounted to the king post 78 with a sheave mount 93*a*.

The first luffing wire 82 can extend from the first turn down sheave 86 to the first tensioner 90, which can function to apply and release tension to the first luffing wire 82. The amount of tension applied to the first luffing wire 82 can be an amount sufficient to hold the first telescoping soft yoke mooring arm 68 or greater. The second luffing wire 84 can extend from the second turn down sheave 88 to the second tensioner 91, which can function to apply and release tension to the second luffing wire 84. The amount of tension applied to the second luffing wire 84 can be an amount sufficient to hold the first telescoping soft yoke mooring arm 68 or greater.

For example, in operation the first and second tensioners 90 and 91 can be used to apply tension to the first and second luffing wires 82 and 84, allowing the boom 80 to be raised towards the first position with an upward movement away from any deck of a transport vessel. When the first and second tensioners 90 and 91 release tension from the first and second luffing wires 82 and 84, the boom 80 can be lowered towards the second position with a downward movement towards a surface of the sea and towards a deck of a transport vessel.

A jib 92 can be nested within the boom 80, allowing the jib 92 to have an extended position and a retracted position, and enabling the jib 92 to be telescopically contained within the boom 80. The jib 92 can be a tubular. The jib 92 can have a diameter ranging from about 12 feet to about 14 feet. The tubulars of the jib 92 can be made of hollow tubular steel.

The jib 92 can be controlled by at least one centralizing cylinder, such as a first centralizing cylinder 94 and a second centralizing cylinder 95.

The first and second centralizing cylinders 94 and 95 can control a position of the jib 92 within the boom 80. For example, the first and second centralizing cylinders 94 and 95 can be mounted in parallel on the opposite sides of the boom 80 to extend and retract the jib 92 within the boom 80.

The soft yoke 66 can connect between a floating gas processing station or the like and a transport vessel or the like. As such, the soft yoke 66 can be used to accommodate for environmental factors that can shift a position of the transport vessel, the floating natural gas processing station, the soft yoke 66, the like, or combinations thereof, to allow for continuous loading of liquefied natural gas, and to allow for safe transfer of people and equipment over a gangway formed using the soft yoke 66.

The soft yoke 66 can provide for higher levels of safety by maintaining safe distances using computer controlled devices between the transport vessel and the floating natural gas processing station and the like, and by providing for quick connects and emergency disconnects in case of fire, high winds, or rogue waves. The environmental factors can include wave motions, current motions, wind, transport vessel dynamics or the like, floating natural gas processing station dynamics or the like, changes in draft, and other such external and internal variables.

The first and second centralizing cylinders 94 and 95 can each be hydraulic or pneumatic cylinders, or combinations thereof, and can be connected to one or more accumulators 104*a*, 104*b*, 104*c*, and 104*d*. Any number of accumulators can be used.

The first and second centralizing cylinders 94 and 95 can extend and retract the jib 92 to maintain the transport vessel or the like at a nominal standoff position within preset limits from the floating natural gas processing station or the like.

The soft yoke 66 can prevent disconnection of any conduits communicating between the floating natural gas processing station and the transport vessel or the like, by maintaining the correct spacing between the floating natural gas processing station and the transport vessel.

Preset distances or limits from the floating natural gas processing station or the like can be any distance required for the particular application. The preset limits can be any allowable range of variation from the predefined distance required for the particular application. For example, in an application with a nominal distance of one hundred feet, and a preset limit of plus or minus ten feet, the first and second centralizing cylinders 94 and 95 can operate to extend and retract the jib 92 to maintain the nominal standoff position from about ninety feet to about one hundred ten feet. The nominal standoff position can be a length of the boom 80 plus a length of the jib 92 extending from the boom 80.

The soft yoke 66 can include conduits for flowing fluid between floating natural gas processing stations and transport vessels or the like. For example, the soft yoke 66 can include a yoke offload flexible conduit 98 and a yoke vapor return flexible conduit 99. The yoke offload flexible conduit 98 can be used to flow fluid, such as liquefied natural gas, from the floating natural gas processing stations to waiting transport vessels or the like. The fluid can be a liquefied natural gas or another liquid.

The yoke offload flexible conduit 98 can flow the fluid from the floating natural gas processing station into storage tanks on the transport vessel. The transport vessel can receive, store, transport, and offload the fluid.

The yoke vapor return conduit 99 can flow hydrocarbon vapor formed during offloading of the fluid back from the transport vessel to the floating natural gas processing station.

Figure 5:
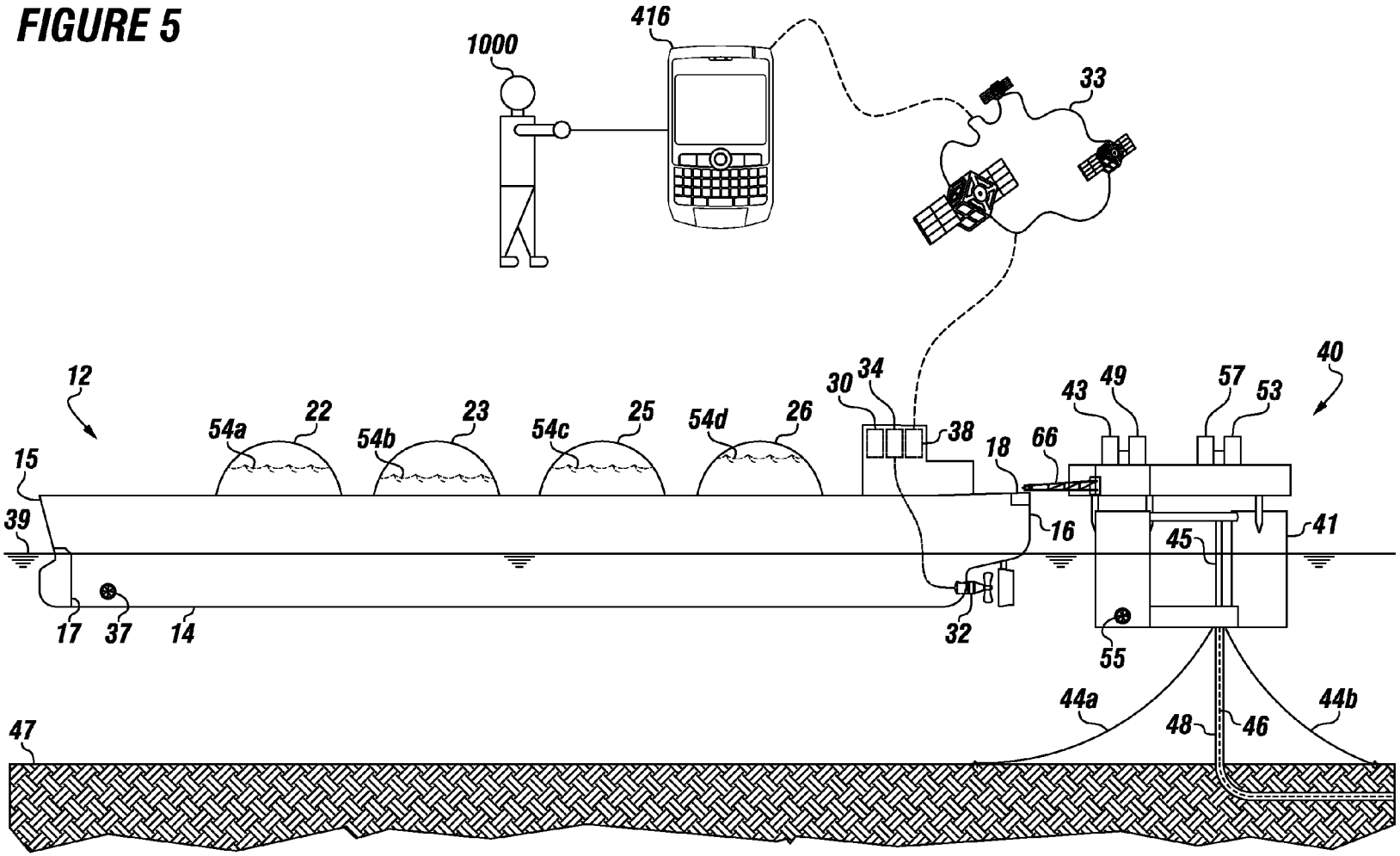
FIG. 5 depicts a soft yoke connecting between a transport ship and a floating natural gas processing station along with a user in communication with a network.

For example, the yoke vapor return flexible conduit 99 can be in fluid communication with a station heat exchanger (shown in FIG. 5). The station heat exchanger can be a cold box, for receiving the formed vapor and cooling the vapor for reprocessing using a station mounted liquefaction train (also shown in FIG. 5). The hydrocarbon vapor can serve as a fuel supply for the floating natural gas processing station or the like.

The yoke offload flexible conduit 98 and the yoke vapor return conduit 99 can each be made from about eight inch to about ten inch diameter rigid pipe, or from a similar diameter flexible composite cryogenic hose, or combinations thereof. The yoke offload flexible conduit 98 and the yoke vapor return conduit 99 can be any size or material as required for the particular application, given particular flow rates, pressures, and storm conditions. For example, the yoke offload flexible conduit 98 and the yoke vapor return conduit 99 can be 3 inch or larger diameter reinforced hose, a draped hose, or a festooned hose.

The yoke offload flexible conduit 98 can have a jib flexible portion 109*a*, and the yoke vapor return flexible conduit 99 can have a jib flexible portion 109*b*. The jib flexible portions 109*a* and 109*b* can allow the yoke offload flexible conduit 98 and the yoke vapor return conduit 99 to move easily along with the boom 80 as the jib 92 expands and retracts within the boom 80. Since the boom 80 can be raised and lowered using the first and second tensioners 90 and 91, the jib flexible portions 109*a* and 109*b* can enable the yoke offload flexible conduit 98 and the yoke vapor return conduit 99 to have enough range of motion and flexibility to move with the boom 80 without fracturing or being over tensioned.

The yoke offload flexible conduit 98 can have a first rigid portion 110*a*, and the yoke vapor return flexible conduit 99 can have a second rigid portion 110*b*. The rigid portions 110*a* and 110*b* can provide a rigid connection between the yoke offload flexible conduit 98, the yoke vapor return conduit 99, and the boom 80, allowing the boom 80 to securely move the yoke offload flexible conduit 98 and the yoke vapor return conduit 99 as the boom 80 moves.

The yoke offload flexible conduit 98 and the yoke vapor return flexible conduit 99 can be secured to the boom 80, such as by gussets 105*a* and 105*b*, and support structures 114*a*, 114*b*, and 114*c*. Each support structure 114*a*, 114*b*, and 114 and gusset 105*a* and 105*b* can be pivotable and/or rotatable.

The soft yoke 66 can include one or more low pressure fluid accumulators 113*a*, 113*b*, 113*c*, and 113*d* for the first and second centralizing cylinders 94 and 95. The one or more low pressure accumulators 113*a*, 113*b*, 113*c*, and 113*d* can have a pressure from about 30 psi to about 300 psi each.

The soft yoke 66 can include a connection interface 103 for connecting the soft yoke 66 to the transport vessel or the like. For example, the connection interface 103 can be a primary quick connect/disconnect connector with a secondary emergency disconnect connector and a tertiary disconnect connector that engages a mooring socket on a transport vessel.

The soft yoke 66 can include a stop 404 configured to selectively engage a hydraulic actuator switch 404. For example, the stop 404 can be located on the boom 80, and the hydraulic actuator switch 403 can be located on the jib 92.

FIG. 1C depicts the boom 80 connected to the king post 78 with the first luffing wire 82. The first luffing wire 82 can hold the boom 80 in a first position 107. The second position 108 also is depicted. The boom 80 can be lowered to the second position 108. Also shown are the jib 92 and the jib flexible portion 109*a*.

Figure 2A:
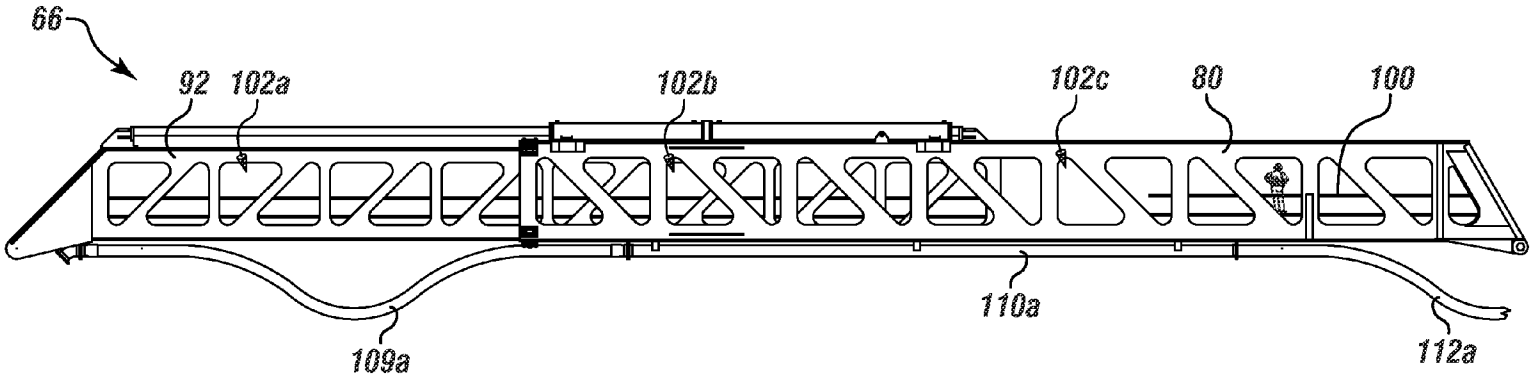
FIG. 2A depicts a side view of a portion of the soft yoke in an extended position.

FIG. 2A depicts the soft yoke 66 with the jib 92 and the boom 80 nested together. A secure enclosed gangway 100 can be formed that allows wind and water to pass through the secure enclosed gangway 100 without deforming, and allows people to pass between the transport vessel and the floating station or the like.

The secure enclosed gangway 100 can have openings 102*a*, 102*b*, and 102*c*, which can provide ventilation and allow spray and wind to pass through the secure enclosed gangway 100 without pulling a person into the sea.

The secure enclosed gangway 100 can function to allow for personnel to move between transport vessel and floating natural gas processing stations when the soft yoke 66 is connected there between. The secure enclosed gangway 100 can be made of aluminum, steel, or another material. The secure enclosed gangway 100 can have an anti-slip tread, handrails, lighting, and other safety features.

The jib 92 is depicted in a partially extended position relative to the boom 80 with the jib flexible portion 109*a* slightly tensioned as it connects to the rigid portion 110*a*. The rigid portion 110*a* is shown connected to the boom flexible portion 112*a*.

The boom flexible portion 112*a* can allow the conduits of the soft yoke 66 to move extend and retract along with the jib 92. For example, when the jib 92 is extended and retracted using the centralizing cylinders, the boom flexible portion 112*a* can provide the conduits with enough range of motion and flexibility to extend and retract with the jib 92 without fracturing or being over tensioned.

Figure 2B:
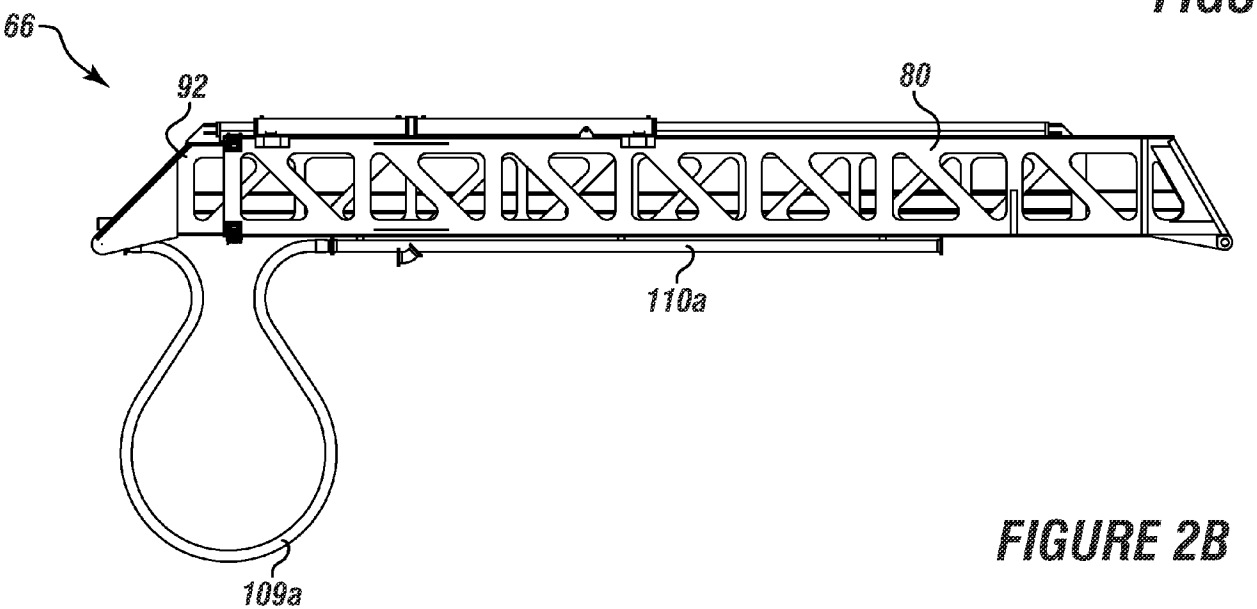
FIG. 2B depicts a side view of a portion of the soft yoke in a retracted position.

FIG. 2B depicts the same side view of a portion of the soft yoke 66 as FIG. 2A with the jib 92 depicted in a retracted position relative to the boom 80. The jib flexible portion 109*a* is depicted connected to the rigid portion 110*a*, with little or no tension, having an extra "scope" or lengths in a loop.

The jib flexible portion 109*a* is configured to have a length sufficient to have enough range of motion and flexibility to extend and retract along with the jib 92. The boom flexible portion can be configured the same as the jib flexible portion 109*a*, and can function in the same manner.

Figure 2C:
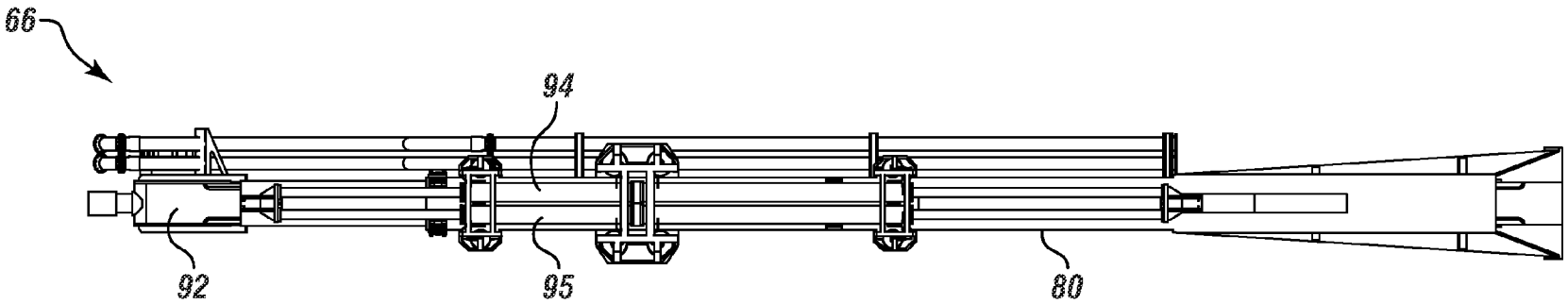
FIG. 2C depicts a top view of a portion of the soft yoke in the extended position.

FIG. 2C depicts a top view of a portion of the soft yoke 66 having the first and second centralizing cylinders 94 and 95 configured to actuate for extending and retracting the jib 92 relative to the boom 80.

Figure 3A:
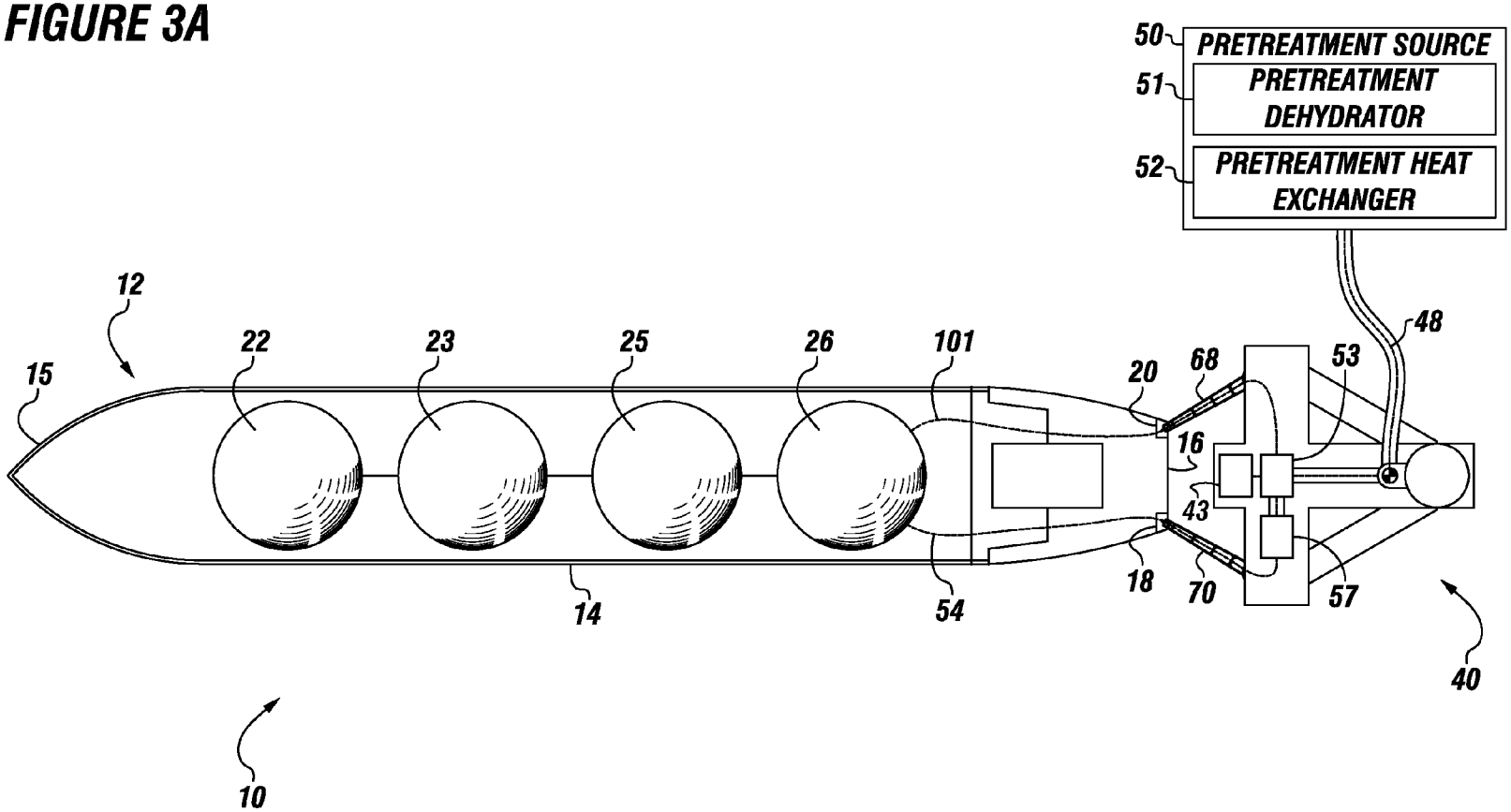
FIG. 3A depicts two soft yoke mooring arms connecting between a floating natural gas processing station and a transport ship.

FIG. 3A depicts a top view of a system 10 with the first telescoping soft yoke mooring arm 68 and a second telescoping soft yoke mooring arm of 70 connecting the floating natural gas processing station 40 to a transport vessel 12. The transport vessel 12 can have a vessel hull 14 between a bow 15 and stern 16. The floating natural gas processing station 40 is depicted as a semisubmersible structure.

In one or more embodiments, the first and second telescoping soft yoke mooring arms 68 and 70 can connect directly to the stern 16 of the transport vessel 12, with the first and second telescoping soft yoke mooring arms 68 and 70 both angled inwards towards the stern 16. First and second mooring sockets 18 and 20 can connect the first and second telescoping soft yoke mooring arms 68 and 70 to stern 16.

A station heat exchanger 53 can be connected to a pretreatment source 50 for receiving dry gas 48 from the pretreatment source 50.

The pretreatment source 50 can have a pretreatment dehydrator 51 and a pretreatment heat exchanger 52. Accordingly, the pretreatment source 50 can be configured to cool and dry natural gas from a wellbore or other source.

The liquefied natural gas 54 can flow from station offload flexible conduits, which are also termed "offload flexible conduits" herein, through the yoke offload conduits to liquefied natural gas storage tanks 22, 23, 25, and 26 on the transport vessel 12.

A hydrocarbon vapor 101 can flow from the transport vessel 12, through yoke vapor return flexible conduits, through station vapor return flexible conduits, and to the station heat exchanger 53.

A station controller 43 can be located on the floating natural gas processing station 40 to control one or more components thereof. The floating natural gas processing station 40 can include one or more liquefaction trains 57 in communication with the station heat exchanger 53.

Figure 3B:
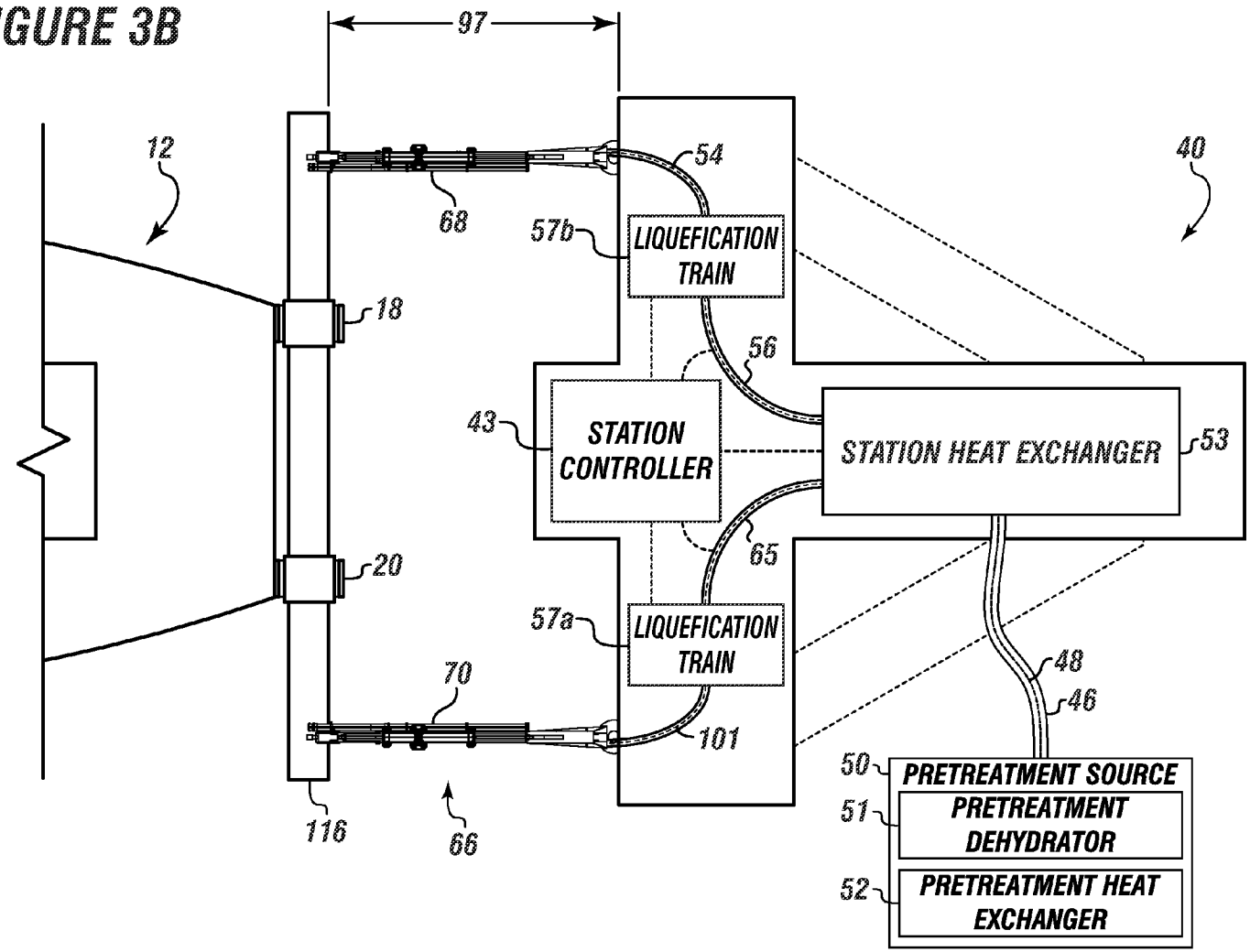
FIG. 3B depicts two soft yoke mooring arms connected to a docking bar removably connected to a transport ship.

FIG. 3B depicts an embodiment of a floating natural gas processing station 40 connected to a transport vessel 12 using the soft yoke 66 with a first telescoping soft yoke mooring arm 68 and a second telescoping soft yoke mooring arm 70 connected to a docking bar 116. The docking bar 116 can connect to the transport vessel 12 via first and second morning sockets 18 and 20.

The station controller 43 can control flow of liquefied natural gas 54, hydrocarbon vapor 101, and can control the station heat exchanger 53.

The transport vessel 12 can be positioned at a nominal standoff position 97 relative to the floating natural gas processing station 40. In one or more embodiments, the first and second telescoping soft yoke mooring arms 68 and 70 can be connected directly to the transport vessel 12 or to the docking bar 116, allowing versatility of connection for vessels with small narrow sterns, and for vessels with larger, wider sterns.

The pretreatment source 50 can communicate with the station heat exchanger 53 via inlet conduit 46, allowing dry gas 48 to flow to the station heat exchanger 53 after passing through the pretreatment heat exchanger 52 and the pretreatment dehydrator 51.

The liquefied natural gas 54 can flow from the floating natural gas processing station 40, through an offload flexible conduit 56 and through corresponding yoke offload flexible conduits on the soft yoke 66 to the transport vessel 12.

The hydrocarbon vapor 101 can return from the transport vessel 12 through yoke vapor return flexible conduits on the soft yoke and through a corresponding vapor return flexible conduit 65 on the floating natural gas processing station 40.

The liquefaction trains 57*a* and 57*b* can functions to cool the station heat exchanger 53. The liquefied natural gas 54 and the hydrocarbon vapor 101 can flow through the liquefaction trains 57*a* and 57*b* between the transport vessel 12 and the station heat exchanger 53.

Figure 4A:
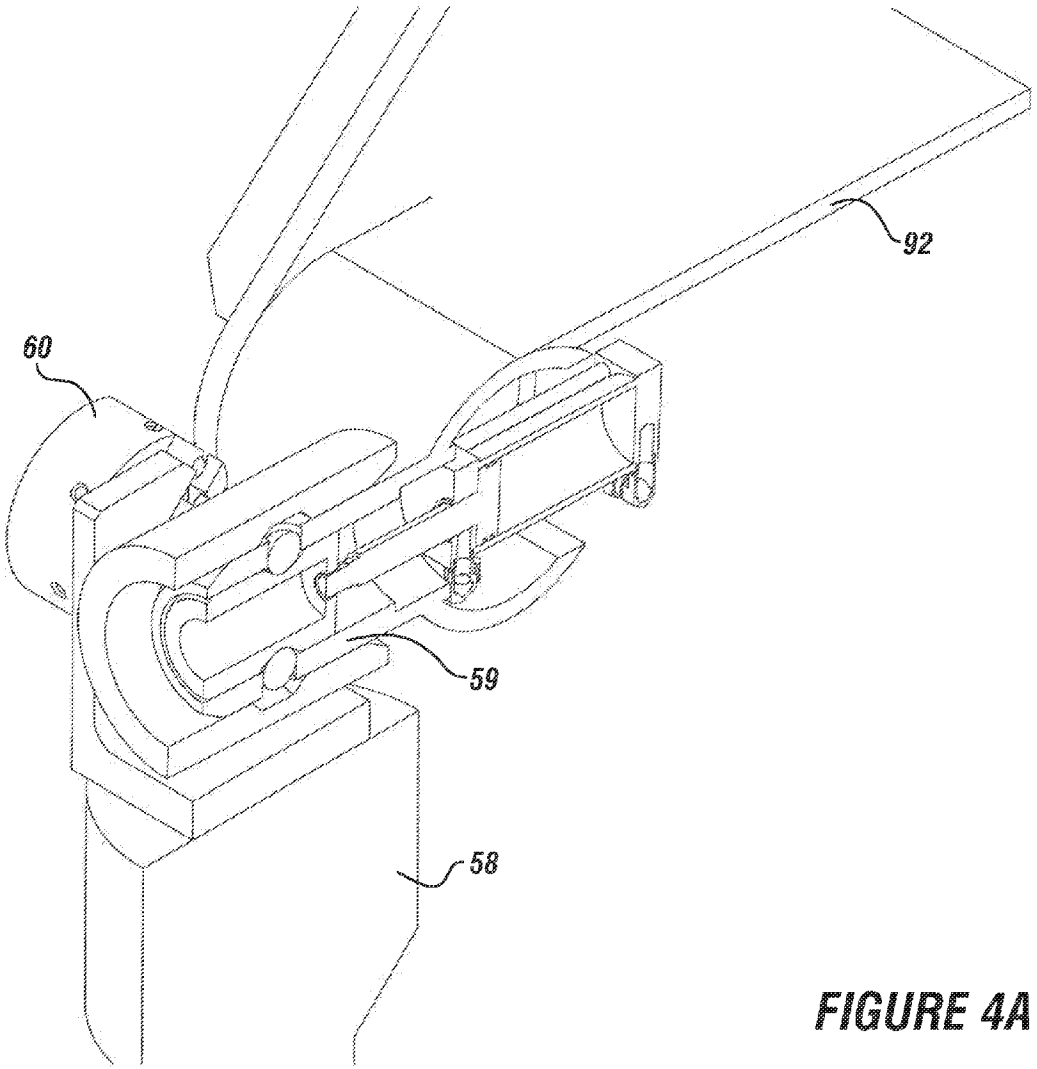
FIG. 4A depicts a cut away view of a secondary emergency disconnect connector along with a primary quick release connector and a tertiary emergency disconnect release connector usable with each soft yoke mooring arm.

FIG. 4A shows the three connectors usable with the system, the primary quick connect/disconnect connector 58, the secondary emergency disconnect connector 59 and the tertiary emergency disconnect connector 60 that connect to the jib 92.

The primary quick connect/disconnect connector 58 can engage a mooring socket on the transport vessel. Hydraulic cylinders can force the quick connect/disconnect connector 58 into the mooring socket.

Figure 4B:
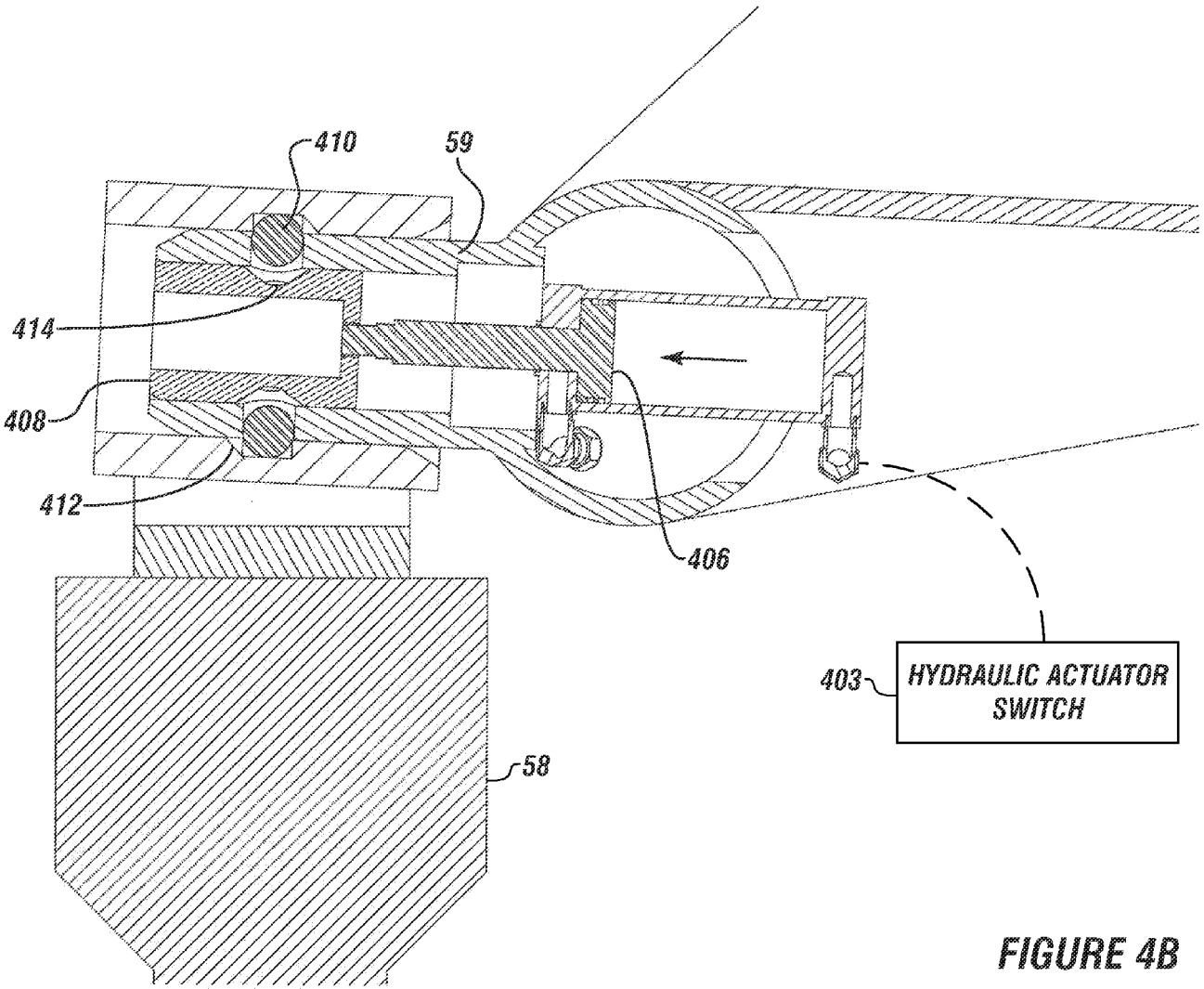
FIG. 4B shows a detailed view of the secondary emergency disconnect connector of FIG. 4A.

FIG. 4B depicts in detail the secondary emergency disconnect connector 59 engaging between the tip of the jib and a first lock release 408 to allow the jib and boom assembly to disconnect and slide away from the primary quick connect/disconnect connector 58.

The secondary emergency disconnect connector 59 can be operatively engaged with an emergency actuator 406, which can be operatively engaged with a hydraulic actuator switch 403. The first lock release 408 can have a pin recess 414 for operatively engaging the emergency actuator 406. Quick release bearings 410 can be disposed between the first lock release 408 and a locking recess sleeve 412.

In operation, the secondary emergency disconnect connector 59 can connect the soft yoke to the transport vessel. A stop can be configured to engage the hydraulic actuator switch 403 when the jib has reached a maximum extension length relative to the boom. The hydraulic actuator switch 403 can be configured to flow hydraulic fluid to the hydraulic actuator 406 upon engagement with the stop. The hydraulic actuator 406 can receive the flowing fluid from the hydraulic actuator switch 403. The hydraulic actuator 406 can push the first lock release 408 upon receipt of the fluid from the hydraulic actuator switch 403.

The first lock release 408 can then disengage the quick release bearings 410 and release the telescoping soft yoke mooring arms from the transport vessel. The quick release bearings 410 move from being engaged within a locking recess sleeve 412 to within a pin recess 414, thereby releasing the soft yoke from the transport vessel.

FIG. 5 depicts a floating natural gas processing station 40 with a soft yoke 66 and a spread moored turret 45. The spread moored turret 45 can be moored to the sea bed 47 with mooring lines 44*a* and 44*b*.

A dry gas inlet conduit 46 can extend into the spread moored turret 45 for communicating dry gas 48 from a pretreatment source for processing on the floating natural gas processing station 40 with a natural gas liquefaction train 57.

The spread moored turret 45 allows the floating natural gas processing station 40 to weather vane according to weather conditions, wind direction, and waves. For example, the spread moored turret 45 allows the floating natural gas processing station 40 to pivot and/or rotate about the spread moored turret 45, while the spread moored turret 45 is fixed by the mooring lines 44*a* and 44*b*.

The floating natural gas processing station 40 can be a ballasted floating vessel with a station hull 41 with a station variable draft.

In embodiments, the floating natural gas processing station 40 can use heading controls 49 connected to thrusters 55, allowing the floating natural gas production station 40 to dynamically maintain position with the transport vessel 12 using GPS positioning with other dynamic positioning equipment to maintain space between the floating natural gas processing station 40 and the transport vessel 12.

A vessel controller 43 can be connected to the heading controls 49 and the station thrusters 55.

The stern 16 of the transport vessel 12 can connect directly to the boom of the soft yoke 66. For example, a first mooring socket 18 can connect to the soft yoke 66. Pivot can be employed with the soft yoke 66 to rotate the mooring arms of the soft yoke 66, allowing the liquefied natural gas 54*a*, 54*b*, 54*c*, and 54*d* to flow into the storage tanks 22, 23, 25, and 26 from the natural gas liquefaction train 57 and/or the station heat exchanger 53.

The transport vessel 12 is shown having a hull 14 with a variable draft 17, allowing the transport vessel 12 to change draft and balance with respect to sea level 39 to be capable of receiving and offloading the processed liquefied natural gas 54*a*-54*d*.

The transport vessel 12 can have a bow 15 opposite the stern 16, with the storage tanks 22, 23, 24, 25, and 26 located on the hull 14. The storage tanks 22, 23, 24, 25 and 26 can be independent of each other.

The transport vessel 12 can include a vessel controller 30 with a processor and data storage for monitoring data associated with the receipt of the processed liquefied natural gas 54*a*-54*d*, the storage of the processed liquefied natural gas 54*a*-54*d*, and the offloading the processed liquefied natural gas 54*a*-54*d* from the transport vessel 12.

The transport vessel 12 can include a propulsion system 32 for moving the transport vessel 12 and a navigation system 34 for controlling the propulsion system 32.

The transport vessel 12 can have a station keeping device 38 that operates dynamic positioning thrusters 37. The station keeping device 38 and the navigation system 34 can communicate with a network 33, shown here as a satellite network, for dynamic positioning of the floating vessel 12. Client devices 416 with computer instructions can communicate with the network 33, allowing a remote user 1000 to monitor the processing, storage, and offloading.

Figure 6A:
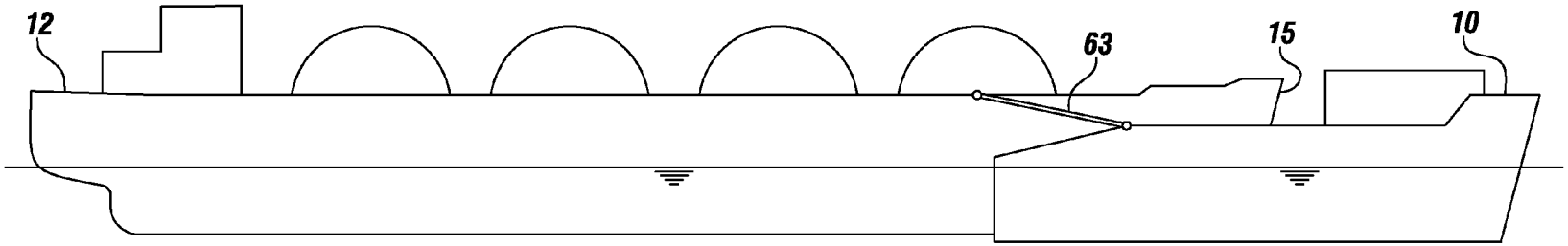
FIG. 6A depicts a side view of a transport ship connected to a natural gas processing station using a docking notch and at least one mooring arm.
Figure 6B:
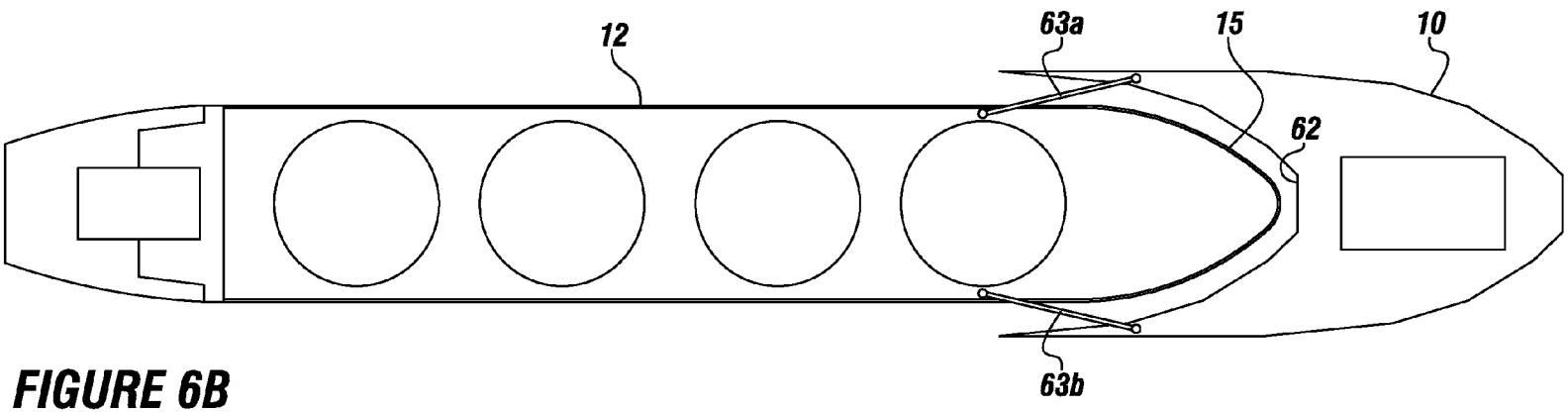
FIG. 6B depicts a top view of the embodiment of FIG. 6A.

FIGS. 6A and 6B depict an embodiment for connecting a transport vessel 12 and a floating natural gas processing station 10. The floating natural gas processing station 10 is depicted as a floating vessel without propulsion, such as a barge. The floating natural gas processing station 10 can have a docking notch 62 for accepting the bow 15 of the transport vessel 12. Mooring arms 63, 63*a*, and 63*b* are shown connected to the station hull of the floating natural gas processing station 10 for holding the transport vessel 12 in the docking notch 62.

The floating natural gas processing station 10 can have a station variable draft and can be ballasted like the transport vessel 12.

Figure 7:
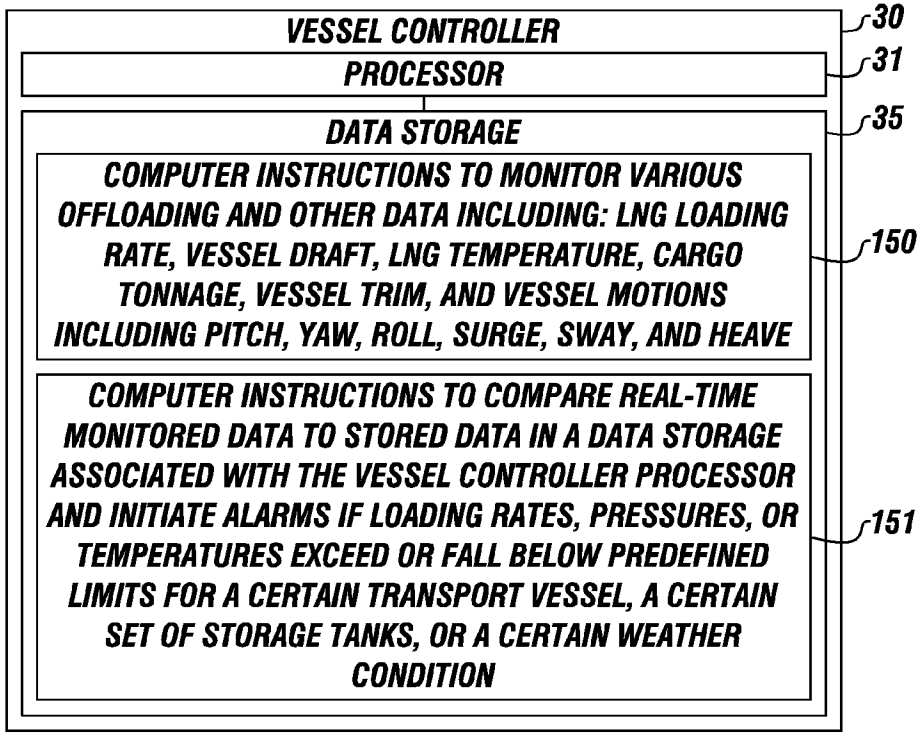
FIG. 7 depicts an embodiment of a vessel controller.

FIG. 7 depicts an embodiment of a vessel controller 30 with a processor 31 and a data storage 35.

The data storage 35 can have computer instructions 150 to monitor various offloading and other data including: LNG loading rate, vessel draft, LNG temperature, cargo tonnage, vessel trim, and vessel motions including pitch, yaw, roll, surge, sway, and heave.

The data storage 35 can have computer instructions 151 to compare real-time monitored data to stored data in a data storage associated with the vessel controller processor and initiate alarms if loading rates, pressures, or temperatures exceed or fall below predefined limits for a certain transport vessel, a certain set of storage tanks, or a certain weather condition.

Figure 8:
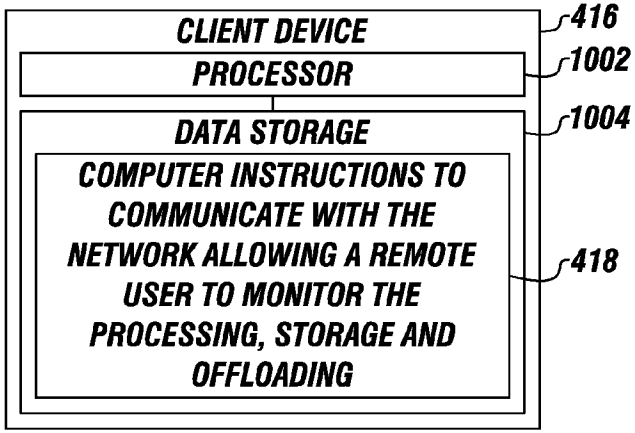
FIG. 8 depicts an embodiment of a client device.

FIG. 8 depicts an embodiment of a client device 416 with a processor 1002 and a data storage 1004. The data storage 1004 can have computer instructions 418 to communicate with the network allowing a remote user to monitor the processing, storage and offloading.

Figure 9A:
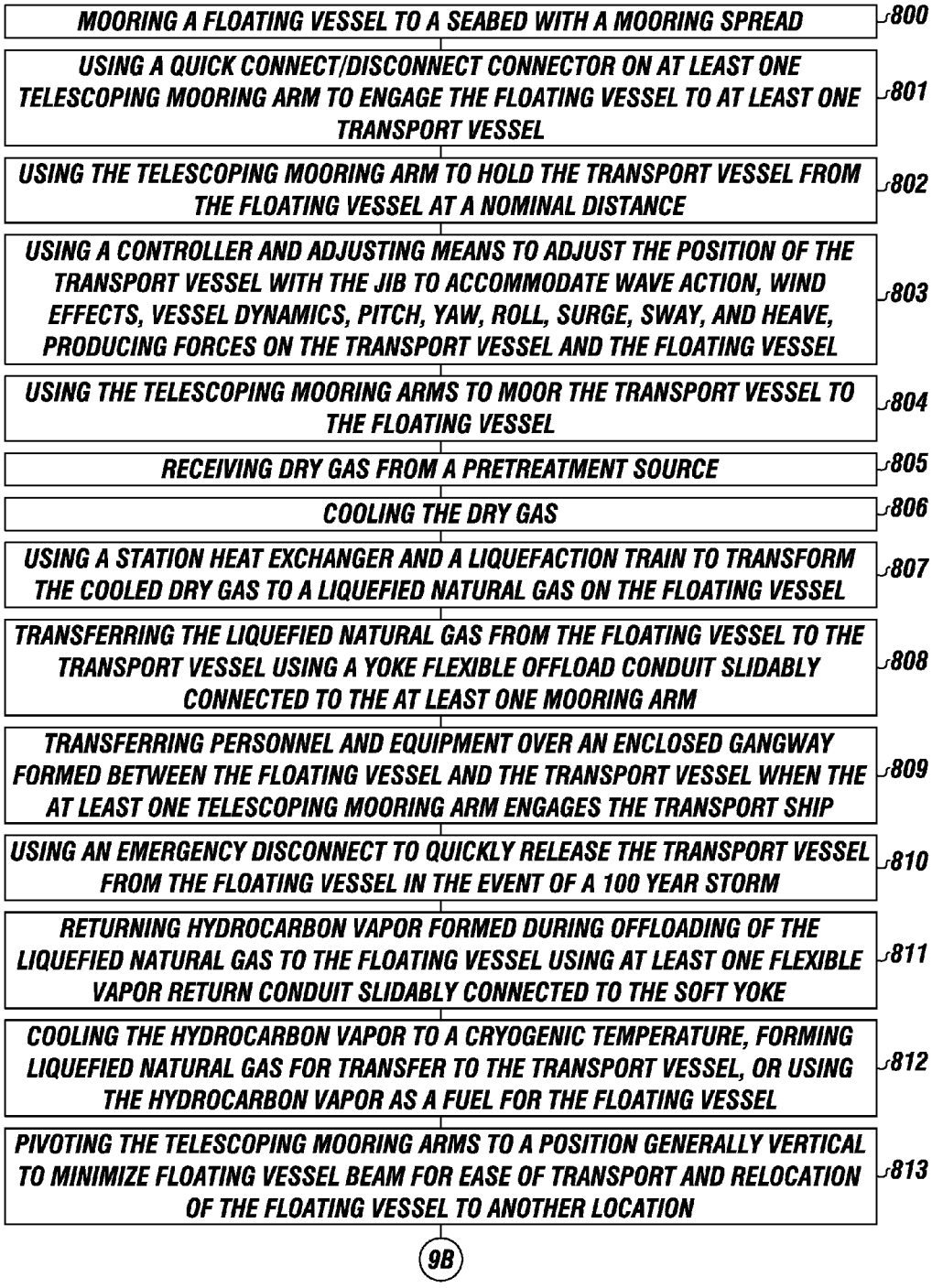
FIGS. 9A-9B depict an embodiment of the method.
Figure 9B:
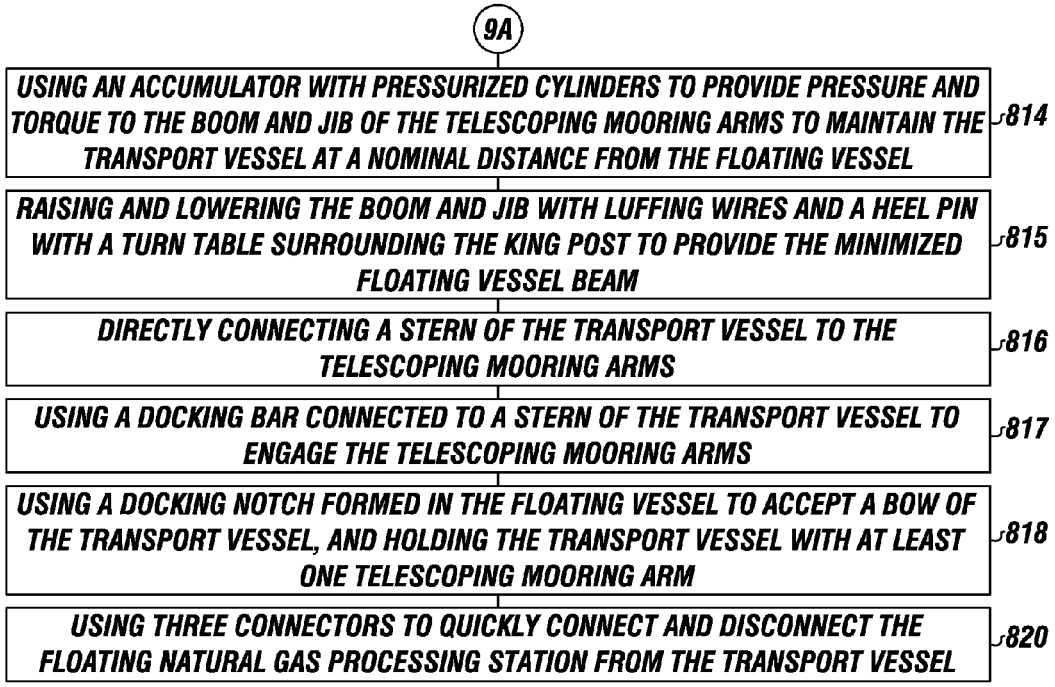

FIGS. 9A-9B depict an embodiment of a method.

The method can be a moveable relocatable method for processing natural gas in deep water using a floating vessel.

Step 800 can include mooring a floating vessel to a seabed with a mooring spread.

For example, a turret can be connected to the mooring lines forming a spread moored turret, allowing the floating vessel to weather vane according to weather conditions, direction of wind, and direction of waves around the turret.

Step 801 can include using a quick connect/disconnect connector on at least one telescoping mooring arm to engage the floating vessel to at least one transport vessel.

The telescoping mooring arm can have a boom with a moveable jib slidably disposed inside the boom.

Step 802 can include using the telescoping mooring arm to hold the transport vessel from the floating vessel at a nominal distance.

Step 803 can include using a controller and adjusting means to adjust the position of the transport vessel with the jib to accommodate wave action, wind effects, vessel dynamics, pitch, yaw, roll, surge, sway, and heave, producing forces on the transport vessel and the floating vessel.

Step 804 can include using the telescoping mooring arms to moor the transport vessel to the floating vessel.

Step 805 can include receiving dry gas from a pretreatment source.

The dry gas can be received at a rate of at least 200 million standard cubic feet per day through an inlet conduit onto the floating vessel. The dry gas can be primarily methane with small amounts of ethane onto a floating vessel.

Step 806 can include cooling the dry gas.

The dry gas can be cooled to a cryogenic temperature no warmer than −262 degrees Fahrenheit, forming a cooled dry gas on the floating vessel.

Step 807 can include using a station heat exchanger and a liquefaction train to transform the cooled dry gas to a liquefied natural gas on the floating vessel.

Step 808 can include transferring the liquefied natural gas from the floating vessel to the transport vessel using a yoke flexible offload conduit slidably connected to the at least one mooring arm.

The liquefied natural gas can be transferred at a temperature no warmer than −262 degrees Fahrenheit.

Step 809 can include transferring personnel and equipment over an enclosed gangway formed between the floating vessel and the transport vessel when the at least one telescoping mooring arm engages the transport ship.

Step 810 can include using an emergency disconnect to quickly release the transport vessel from the floating vessel in the event of a 100 year storm.

Step 811 can include returning hydrocarbon vapor formed during offloading of the liquefied natural gas to the floating vessel using at least one flexible vapor return conduit slidably connected to the soft yoke.

Step 812 can include cooling the hydrocarbon vapor to a cryogenic temperature, forming liquefied natural gas for transfer to the transport vessel, or using the hydrocarbon vapor as a fuel for the floating vessel.

Step 813 can include pivoting the telescoping mooring arms to a position generally vertical to minimize floating vessel beam for ease of transport and relocation of the floating vessel to another location.

Step 814 can include using an accumulator with pressurized cylinders to provide pressure and torque to the boom and jib of the telescoping mooring arms to maintain the transport vessel at a nominal distance from the floating vessel.

Step 815 can include raising and lowering the boom and jib with luffing wires and a heel pin with a turn table surrounding the king post to provide the minimized floating vessel beam.

Step 816 can include directly connecting a stern of the transport vessel to the telescoping mooring arms.

Step 817 can include using a docking bar connected to a stern of the transport vessel to engage the telescoping mooring arms.

Step 818 can include using a docking notch formed in the floating vessel to accept a bow of the transport vessel, and holding the transport vessel with at least one telescoping mooring arm.

Step 820 can include using three connectors to quickly connect and disconnect the floating natural gas processing station from the transport vessel.

The three connectors can include a primary quick connect/disconnect connector, a secondary emergency disconnect connector, and a tertiary emergency disconnect connector used simultaneously by the floating ballasted station to engage or release the transport vessel.

While these embodiments have been described with emphasis on the embodiments, it should be understood that within the scope of the appended claims, the embodiments might be practiced other than as specifically described herein.

What is claimed is:

1. A floating relocatable method for processing natural gas using a floating vessel, wherein the method comprises:

a. mooring the floating vessel to a seabed with a mooring spread;

b. using a soft yoke having two telescoping mooring arms to moor a transport vessel to the floating vessel, wherein each telescoping mooring arm comprises: a boom with a moveable jib slidably disposed inside the boom, wherein the telescoping mooring arm holds the transport vessel from the floating vessel at a nominal distance using a controller and an adjusting means to adjust the position of the transport vessel with the jib to accommodate wave action, wind effects, vessel dynamics, pitch, yaw, roll, surge, sway, and heave producing forces on the transport vessel and the floating vessel;

c. receiving a dry gas;

d. on the floating vessel: cooling the dry gas to a cryogenic temperature, forming a liquefied natural gas; and e. transferring the liquefied natural gas from the floating vessel to the transport vessel;

f. transferring personnel and equipment over an enclosed gangway formed between the floating vessel and the transport vessel when the at least two telescoping mooring arms engage the transport vessel;

g. returning hydrocarbon vapor to the floating vessel using at least one flexible vapor return conduit slidably connected to the at least two telescoping mooring arms, wherein the hydrocarbon vapor is formed during offloading of the liquefied natural gas from the floating vessel to the transport vessel; and h. cooling the hydrocarbon vapor to a cryogenic temperature and using the hydrocarbon vapor as a fuel for the floating vessel.

2. The method of claim 1, further comprising pivoting the at least telescoping mooring arms to a position generally parallel to a king post used with each telescoping mooring arm to minimize floating vessel beam for ease of transport and relocation of the floating vessel to another location.

3. The method of claim 1, further comprising using an accumulator with pressurized cylinders to provide pressure and torque to the boom and jib to maintain the transport vessel at a nominal distance from the floating vessel.

4. The method of claim 1, further comprising raising and lowering the boom and jib with luffing wires and a heel pin with a turn table surrounding the king post to provide for minimized floating vessel beam.

5. The method of claim 1, further comprising a liquefaction train, wherein the liquefaction train is a dual expansion nitrogen cycle assembly, a single mixed refrigerant assembly, or a dual mixed refrigerant assembly.

6. The method of claim 1, further comprising connecting a turret to the mooring lines forming a spread moored turret that allows the floating vessel to weather vane according to weather conditions, direction of wind, and direction of waves around the turret.

7. The method of claim 1, further comprising directly connecting a stern of the transport vessel to mooring sockets of the floating vessel.

8. The method of claim 1, further comprising using a docking bar connected to a stern of the transport vessel and engaging the at least one telescoping mooring arm with the docking bar.

9. The method of claim 1, further comprising using a docking notch formed in the floating vessel to accept a bow of the transport vessel, and holding the transport vessel with the at least two telescoping mooring arms.

10. The method of claim 1, further comprising using three connectors to quickly connect and disconnect the floating natural gas processing station from the transport vessel, wherein the three connectors comprise a primary quick connect/disconnect connector, a secondary emergency disconnect connector, and a tertiary emergency disconnect connector used simultaneously by the floating ballasted station to engage or release the transport vessel.

* * * * *